US007730550B2

(12) United States Patent
Chiang

(10) Patent No.: US 7,730,550 B2
(45) Date of Patent: Jun. 8, 2010

(54) KNEE SUPPORT

(76) Inventor: Pang-Ching Chiang, 9F, No. 295, Sec. 4, Chung-Hsiao E. Rd., Taipei (TW)

( * ) Notice: Subject to any disclaimer, the term of this patent is extended or adjusted under 35 U.S.C. 154(b) by 28 days.

(21) Appl. No.: 11/984,612

(22) Filed: Nov. 20, 2007

(65) Prior Publication Data

US 2009/0126065 A1 May 21, 2009

(51) Int. Cl.
*A41D 13/00* (2006.01)

(52) U.S. Cl. ..... 2/24

(58) Field of Classification Search ..... 2/455, 2/24, 62, 911; 128/881, 882; 602/26, 62
See application file for complete search history.

(56) References Cited

U.S. PATENT DOCUMENTS 4,275,716 A * 6/1981 Scott, Jr. ..... 602/26
5,417,646 A * 5/1995 Gauvry ..... 602/26
5,417,647 A * 5/1995 Down ..... 602/26
6,402,712 B1 * 6/2002 Gauvry ..... 602/26

* cited by examiner

*Primary Examiner*—Tejash Patel
(74) *Attorney, Agent, or Firm*—Muncy, Geissler, Olds & Lowe, PLLC

(57) ABSTRACT

A knee support has a body and two pressing strips. The body is a band having two ends, a central segment, a protecting portion, and a shockproof pad. The protecting portion is formed in the central segment of the body. The two pressing strips are formed on the outer surface of the body and each has a distal end and a connector being formed on the distal end. The distal end of the pressing strip mounted through the ring, folded back on itself and attached to the body using the connector. The body orientates and holds the knee support in position while the pressing strip presses tightly against and supports a patella of the knee. The knee support prevents discomfort associated with loss of blood and provides good shock-absorption for the knee.

18 Claims, 7 Drawing Sheets

KNEE SUPPORT

BACKGROUND OF THE INVENTION

1. Field of the Invention

The present invention relates to a knee support especially to a knee support having two modulated pressing strips to provide better support without causing discomfort due to reduced blood circulation.

2. Description of the Related Art

A human leg comprises a patellar tendon, a quadriceps, a patella and a tibia interconnected at a knee joint.

The patellar tendon connects the quadriceps muscle to the tibia incorporating the patella and provides force to allow the knee joint to open. Patella tendons are soft and fragile and can be injured by running or jumping, especially due to impact or over-repetition due to over-training.

People usually wear protecting apparatus, for example, knee supports to prevent impact or repetition injury of the patella tendon. With reference to FIG. 6, a conventional knee support comprises a body (30) and a pressing strip (40). The body (30) is in a band having two ends, a central segment, two connectors (31,32) and a pad (33). The two connectors (31, 32) are mounted respectively at the ends of the body (30) and may be hook and loop fasteners. The pad (33) is made of sponge or cotton and mounted in the central segment of the body (30).

With further reference to FIG. 7, when using the conventional knee support, the body (30) is mounted loosely around the knee with the pad (33) adjacent to the patella tendon. The connectors (31, 32) hold each other to allow the body (30) to be held on the knee joint.

The pressing strip (40) is formed on the outer surface of the body (30) and comprises a mounting strip and a holding strip having an end. The holding strip is fed through the mounting strip, pulled and fastened against itself to hold the knee support firmly on the knee joint.

However, the conventional knee support is made from resilient materials and cannot provide adequate impact protection, especially impacts involving hard surfaces.

Moreover, tightening the conventional knee support causes the resilient materials to stretch reducing blood circulation around the knee and causing discomfort.

SUMMARY OF THE INVENTION

The main objective of the present invention is to provide a knee support having two modulated pressing strips for providing support without causing discomfort due to reduced blood circulation.

The knee support has a body and two pressing strips. The body is a band having two body ends, a central segment, a protecting portion, and a shockproof pad. The protecting portion is formed in the central segment of the body. The two pressing strips are formed on the outer body surface of the body and each has a distal end and a connector being formed on the distal end. The distal end of the pressing strip mounted through the ring, folded back on itself and attached to the body using the connector. The body orientates and holds the knee support in position whilst the pressing strip presses tightly against and supports a patella of the knee. The knee support prevents discomfort associated with loss of blood circulation and provides good shock-absorption for the knee.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
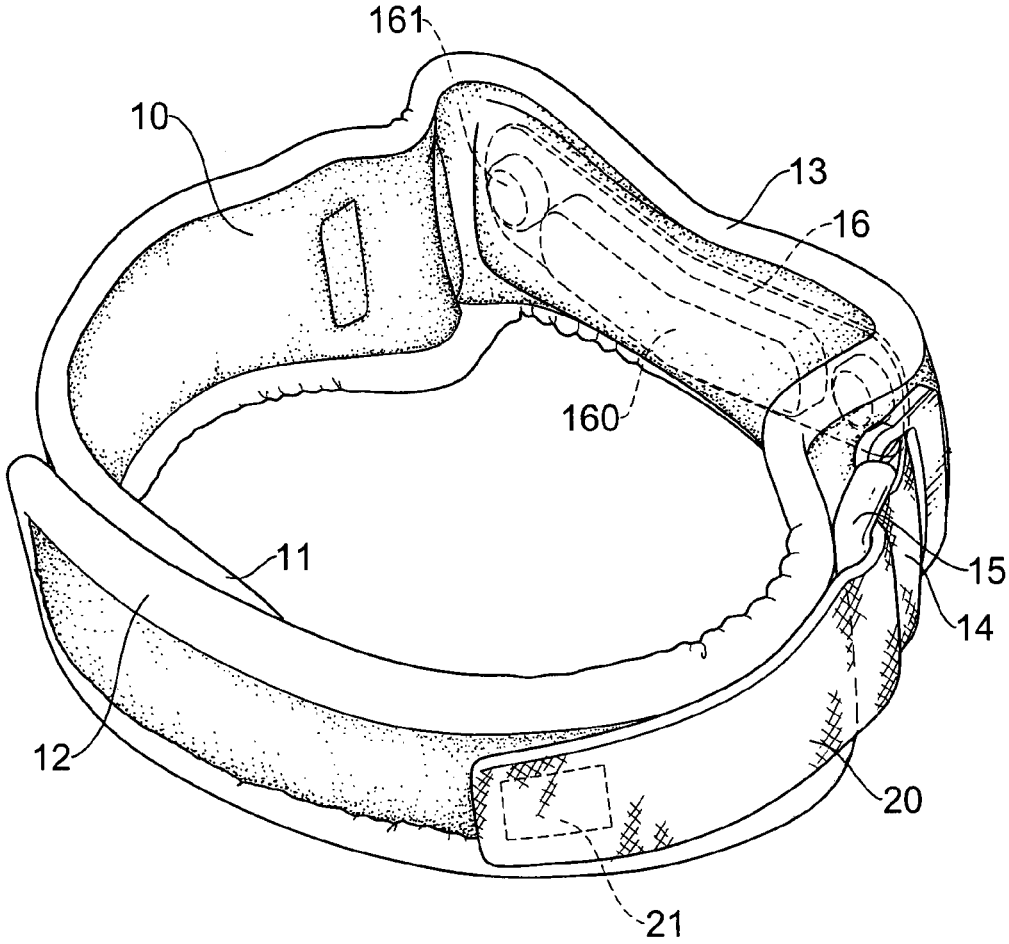
FIG. 1 is a rear perspective view of a knee support in accordance with the present invention.
Figure 2:
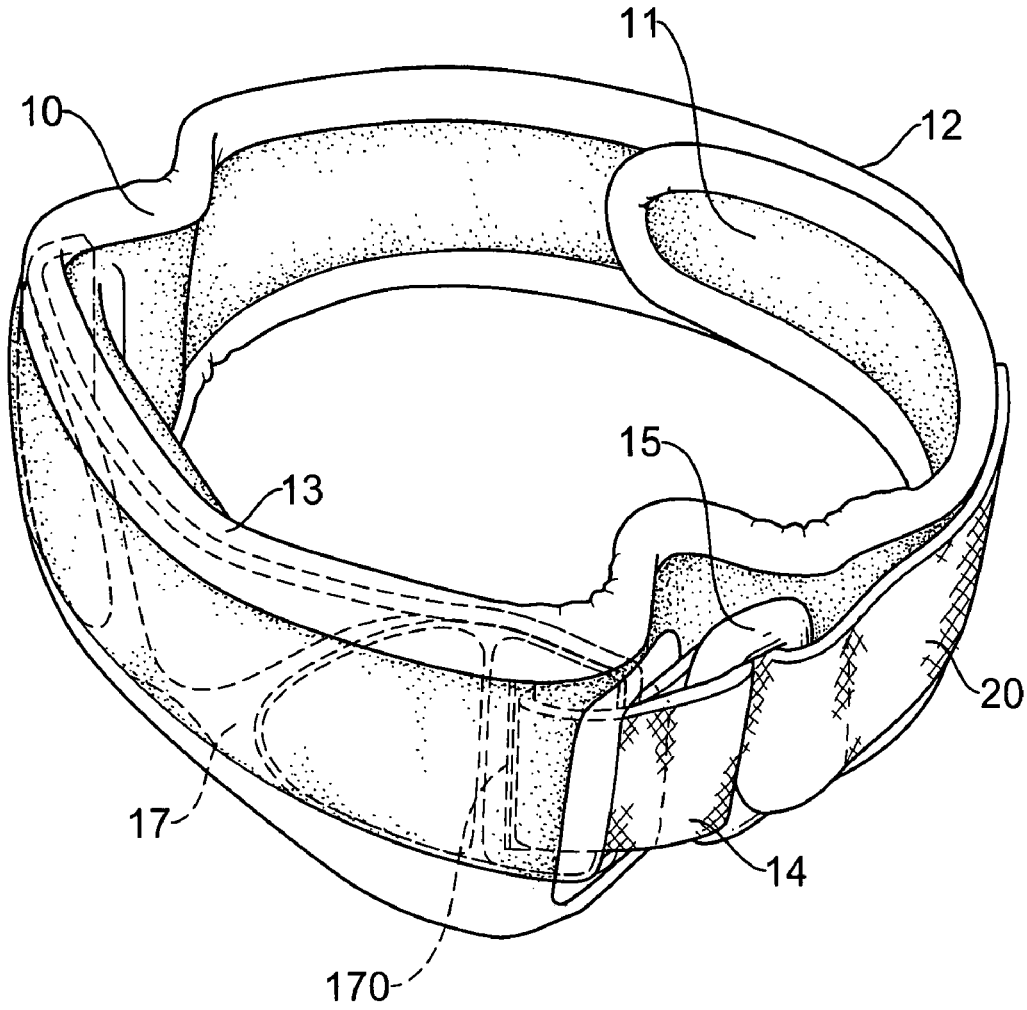
FIG. 2 is a front perspective view of the knee support in FIG. 1, a rigid protecting board shown in phantom lines.
Figure 3:
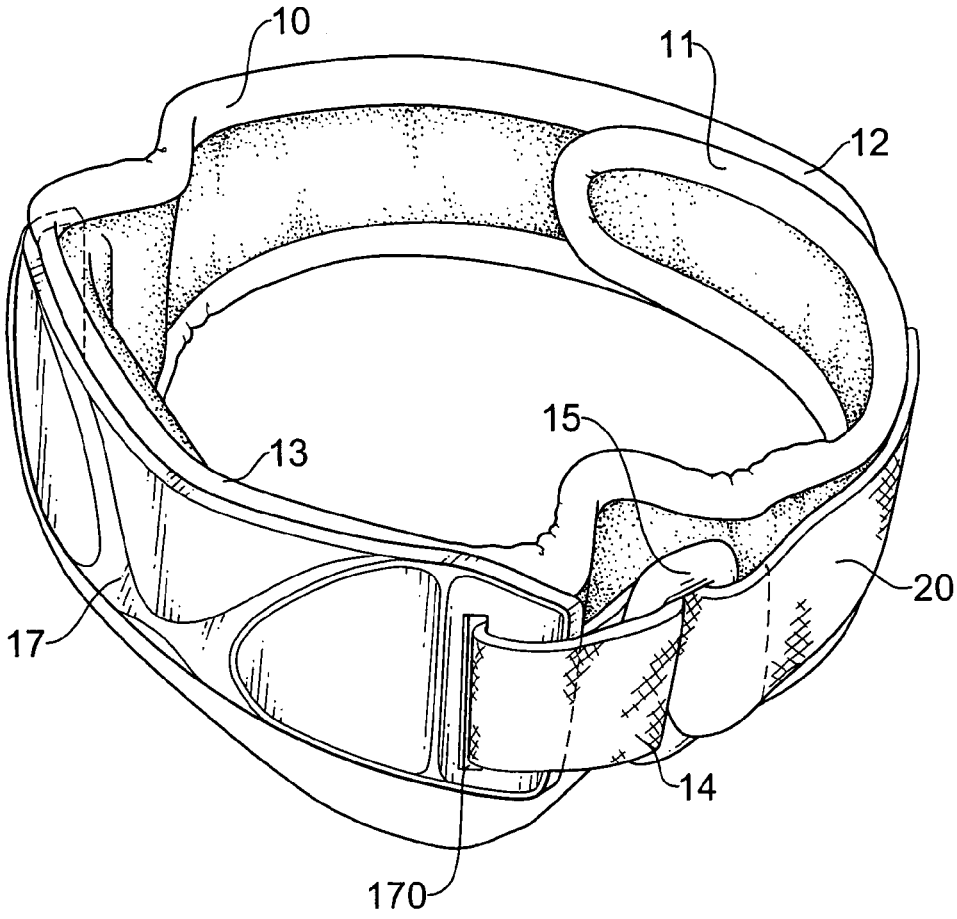
FIG. 3 is a front perspective view of the knee support in FIG. 1, with cushions shown in phantom lines.

With reference to FIGS. 1, 2 and 3, a knee support in accordance with the present invention comprises a body (10) and two pressing strips (20).

The body (10) is in a band and has an outer body surface, two body ends, a central segment, two connectors (11, 12), a protecting portion (13), two resilient mounts (14) and a shockproof pad (16).

The connectors (11, 12) are mounted respectively on the two body ends of the body to connect the body (10) in a loop.

The protecting portion (13) is formed at the central segment of the body (10) and has two protecting portion ends, an outer protecting portion surface and may comprise a rigid protecting board (17). The two resilient mounts (14) are formed respectively through the two protecting portion ends of the protecting portion (13) and each resilient mount (14) has a ring (15).

The shockproof pad (16) is mounted in the protecting portion (13) and has an outer shockproof pad surface, an inner shockproof pad surface, and two shockproof pad ends and may have an elongated cushion (160) and two cushion pads (161). The shockproof pad (16) may be a resilient material. The elongated cushion (160) is formed on and protrudes from the inner shockproof pad surface of the shockproof pad (16) and has two ends. The two cushion pads (161) are formed on and protrude from the inner shockproof pad surface of the shockproof pad (16) adjacent to the two ends of the elongated cushion (160).

The two pressing strips (20) are mounted on the outer body surface of the body (10) adjacent to the rings (15) and each pressing strip has a first distal end, a second distal end and a connector (21). The first distal end of the pressing strip (20) is mounted through the ring (15) and folded back on the pressing strip. Each connector (21) may be a hook and loop connector, such as VELCRO™ and is mounted on the second distal end of the pressing strip (20) to selectively attach the pressing strip (20) to the outer surface of the body (10).

The connectors (11, 12, 21) may be made of VELCRO.

Figure 5:
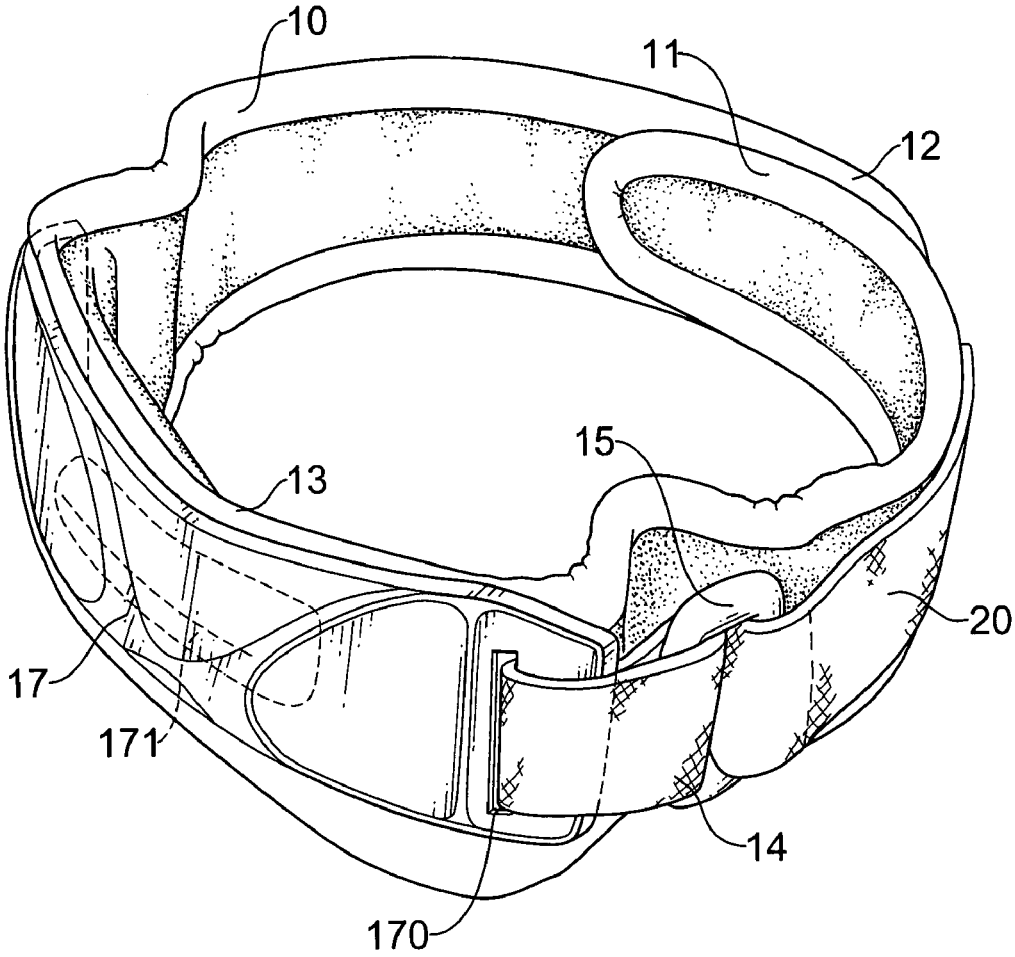
FIG. 5 is a front perspective view of the knee support in FIG. 1, shown with an optional protrusion on a protecting board.
Figure 6:
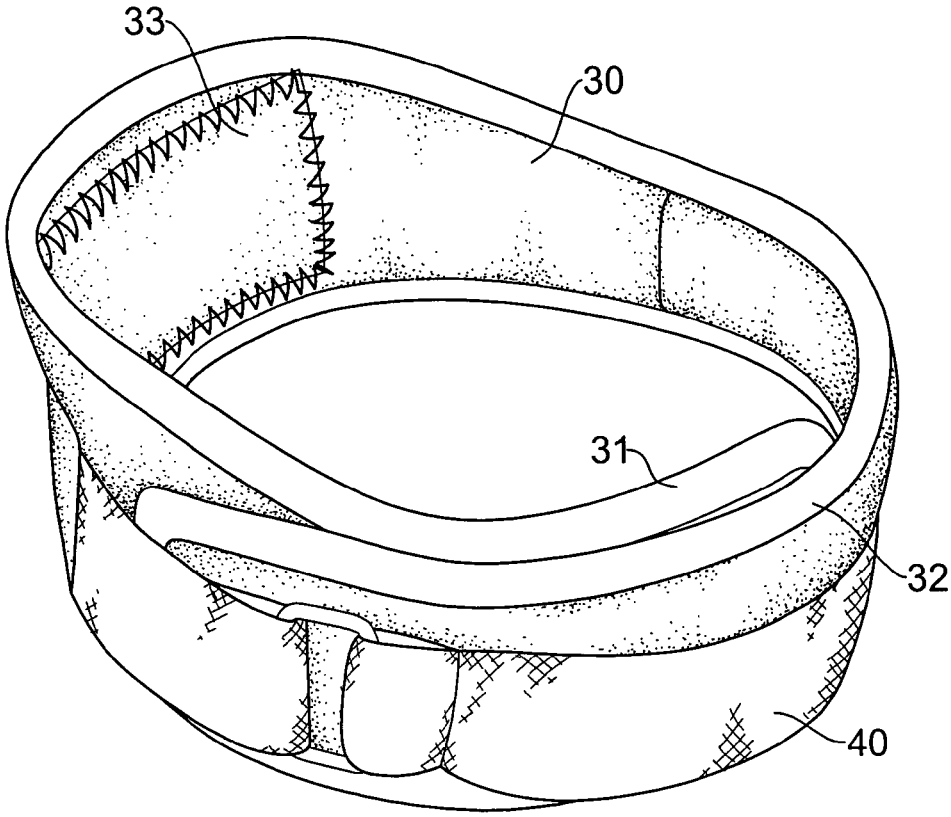
FIG. 6 PRIOR ART
FIG. 6 is a perspective view of a conventional knee support.
Figure 7:
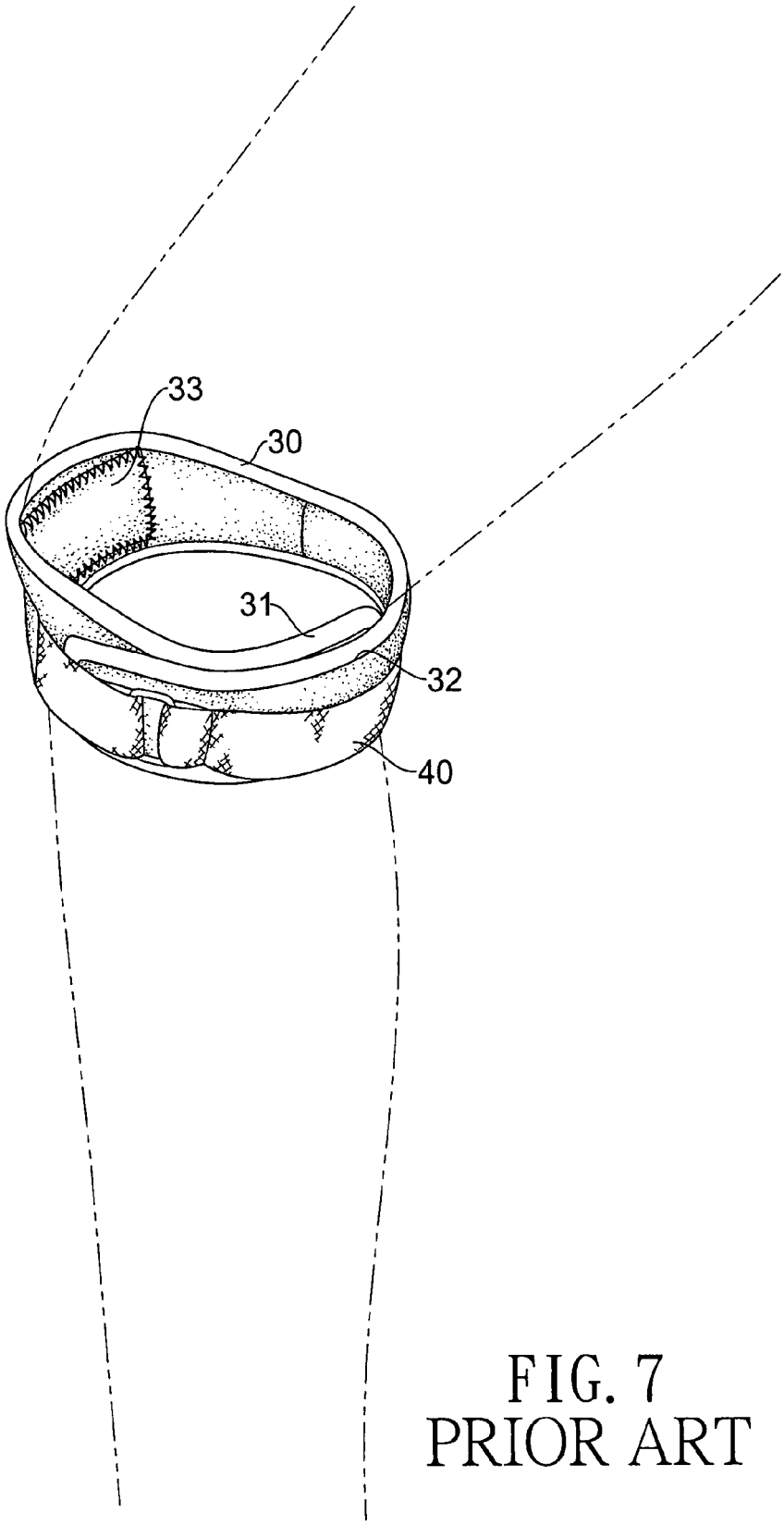
FIG. 7 PRIOR ART
FIG. 7 is an operational view of the conventional knee support in FIG. 6.

With further reference to FIG. 5, the rigid protecting board (17) is mounted on the protecting portion (13). The rigid protecting board (17) may be mounted on the outer protecting portion surface of the protecting portion (13) or attached to the outer shockproof pad surface of the shockproof pad (16) by sewing or gluing. The rigid protecting board (17) has two board ends and may have an inner board surface and a protrusion (171). The rigid protecting board (17) may be plastic and has two through holes (170). The through holes (170) are formed respectively at the two board ends of the rigid protecting board (17) and are mounted around the resilient mounts (14).

The protrusion (171) is formed on the inner surface of the shockproof pad (16) and corresponds to the elongated cushion (160) to press the elongated cushion (160) against a knee.

Figure 4:
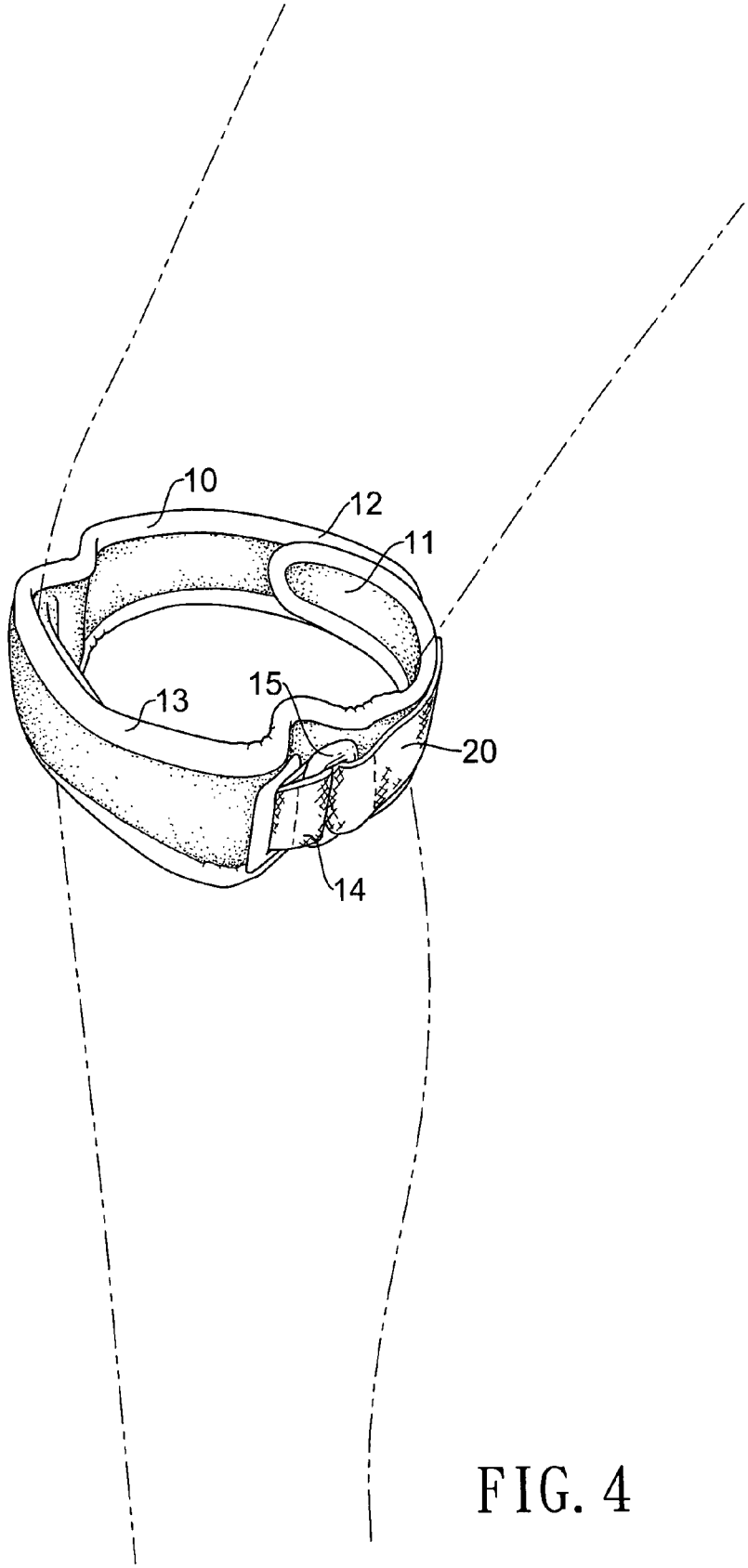
FIG. 4 is an operational front view of the knee support in FIG. 1, shown mounted on a leg in phantom lines.

With further reference to FIG. 4, to wear the knee support, the body (10) is mounted around the knee with the protecting portion (13) adjacent to a patella and the two connectors (11, 12) of the body engaging to each other. The two pressing strips (20) are fed through the ring (15) and pulled back on and mounted against themselves to press the elongated cushion (160) and the cushion pad (161) of the shock proof pad (16) firmly against the knee. The connectors (21) of the pressing strips (20) are then attached to the outer surface of the body (10).

The pressing strips (20) allow the two body ends of the body (10) to orientate correctly to the body (10) on the knee without pressing soft-muscle tissue of the knee and reducing comfort and circulation. Then, the pressing strips (20) can be adjustably tightened to apply pressure as required and protect the knee from injury. Moreover, the rigid protecting board (17) of the present invention prevents impact damage to the patellar.

Therefore, the knee support of the present invention effectively prevents injuries occurred to the tendons, the muscles and bones of the knee.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A knee support, comprising:

a body being a band and having
- an outer body surface;
- two body ends;
- a central segment;
- two connectors being mounted respectively on the two body ends of the body;
- a protecting portion being formed at the central segment of the body and having
  - two protecting portion ends; and
  - an outer protecting portion surface;
- two resilient mounts being formed respectively through the two protecting portion ends of the protecting portion and each resilient mount having a ring; and
- a shockproof pad being mounted in the protecting portion and having
  - an outer shockproof pad surface;
  - an inner shockproof pad surface; and
  - two shockproof pad ends;
- two pressing strips, each pressing strip having
  - a first distal end being mounted through the ring and folded back on the pressing strip;
  - a second distal end; and
  - a connector being mounted on the second distal end of the pressing strip to attach the pressing strip to the outer body surface of the body.

2. The knee support as claimed in claim 1, wherein the protecting portion of the body further comprises a rigid protecting board being attached to the outer shockproof pad surface of the shockproof pad and has two board ends.

3. The knee support as claimed in claim 2, wherein the rigid protecting board is plastic and has two through holes formed respectively through the two board ends of the rigid protecting board and being mounted around the resilient mounts.

4. The knee support as claimed in claim 1, wherein the protecting portion further comprises a rigid protecting board being attached to the outer protecting portion surface of the protecting portion of the body and having two board ends.

5. The knee support as claimed in claim 4, wherein the rigid protecting board is plastic and has two through holes being formed respectively through the two board ends of the rigid protecting board and being mounted around the resilient mounts.

6. The knee support as claimed in claim 4, wherein the rigid protecting board further comprises an inner board surface and a protrusion being formed on and protruding from the inner board surface and corresponding to the shockproof pad.

7. The knee support as claimed in claim 1, wherein
- the shockproof pad is a resilient material and further comprises:
- an elongated cushion formed on and protruding from the inner shockproof pad surface of the shockproof pad and has two ends; and
- two cushion pads formed on and protruding from the inner shockproof pad surface of the shockproof pad adjacent to the two ends of the elongated cushion.

8. The knee support as claimed in claim 2, wherein
- the shockproof pad is a resilient material and further comprises:
- an elongated cushion is formed on and protruding from the inner shockproof pad surface of the shockproof pad and has two ends; and
- two cushion pads formed on and protruding from the inner shockproof pad surface of the shockproof pad adjacent to the two ends of the elongated cushion.

9. The knee support as claimed in claim 3, wherein
- the shockproof pad is a resilient material and further comprises:
- an elongated cushion is formed on and protruding from the inner shockproof pad surface of the shockproof pad and has two ends; and
- two cushion pads formed on and protruding from the inner shockproof pad surface of the shockproof pad adjacent to the two ends of the elongated cushion.

10. The knee support as claimed in claim 4, wherein the shockproof pad is a resilient material and further comprises:
- an elongated cushion formed on and protruding from the inner shockproof pad surface of the shockproof pad and has two ends; and
- two cushion pads formed on and protruding from the inner shockproof pad surface of the shockproof pad adjacent to the two ends of the elongated cushion.

11. The knee support as claimed in claim 5, wherein
- the shockproof pad is a resilient material and further comprises:
- an elongated cushion formed on and protruding from the inner shockproof pad surface of the shockproof pad and has two ends; and
- two cushion pads formed on and protruding from the inner shockproof pad surface of the shockproof pad adjacent to the two ends of the elongated cushion.

12. The knee support as claimed in claim 6, wherein
- the shockproof pad is a resilient material and further comprises:
- an elongated cushion is formed on and protruding from the inner shockproof pad surface of the shockproof pad and has two ends; and two cushion pads formed on and protruding from the inner shockproof pad surface of the shockproof pad adjacent to the two ends of the elongated cushion.

13. The knee support as claimed in claim 1, wherein the connectors are hook and loop connectors.

14. The knee support as claimed in claim 2, wherein the connectors are hook and loop connectors.

15. The knee support as claimed in claim 3, wherein the connectors are hook and loop connectors.

16. The knee support as claimed in claim 4, wherein the connectors are hook and loop connectors.

17. The knee support as claimed in claim 5, wherein the connectors are hook and loop connectors.

18. The knee support as claimed in claim 6, wherein the connectors are hook and loop connectors.

* * * * *